US006301803B1

(12) United States Patent
Patterson

(10) Patent No.: US 6,301,803 B1
(45) Date of Patent: Oct. 16, 2001

(54) FLEECE LEGGINGS

(76) Inventor: Kellie Patterson, 7723 Lec Dr., Pasadena, MD (US) 21122

( * ) Notice: Subject to any disclaimer, the term of this patent is extended or adjusted under 35 U.S.C. 154(b) by 0 days.

(21) Appl. No.: 09/574,517

(22) Filed: May 19, 2000

Related U.S. Application Data

(60) Provisional application No. 60/135,250, filed on May 21, 1999.

(51) Int. Cl.[7] ..... A41D 17/00
(52) U.S. Cl. ..... 36/2 R; 36/1.5
(58) Field of Search ..... 36/1.5, 2 R, 2 A, 36/2 B

(56) References Cited

U.S. PATENT DOCUMENTS

| | | | | |
|---|---|---|---|---|
| 1,706,709 | * | 3/1929 | Rubin | 36/2 R |
| 1,708,271 | * | 4/1929 | Jensen | 36/2 R |
| 1,730,400 | * | 10/1929 | Wharton | 36/2 R |
| 1,902,584 | * | 3/1933 | Sager | 36/2 R |
| 2,053,813 | | 9/1936 | Brennan . | |
| 2,262,564 | | 11/1941 | Strother et al. . | |
| 3,238,537 | | 3/1966 | Fowler et al. . | |
| 4,458,363 | | 7/1984 | Harvey . | |
| 4,461,098 | * | 7/1984 | Diegelman | 36/2 R |
| 4,542,597 | | 9/1985 | Baptista et al. . | |
| 4,599,812 | | 7/1986 | Harmsen . | |
| 4,604,816 | | 8/1986 | Davison . | |
| 4,713,895 | | 12/1987 | Vallieres . | |
| 4,896,437 | | 1/1990 | Johnson . | |
| 5,165,182 | | 11/1992 | Michael . | |
| 5,170,503 | | 12/1992 | Hightower et al. . | |
| 5,613,250 | | 3/1997 | Bell . | |
| 5,791,164 | * | 8/1998 | Carroll et al. . | |
| 5,867,837 | | 2/1999 | Otto . | |
| 5,887,359 | * | 3/1999 | Falguere | 36/2 R |

FOREIGN PATENT DOCUMENTS

| | | | | |
|---|---|---|---|---|
| 10174 | * | of 1927 | (AU) | 36/2 R |
| 1126925 | * | 12/1956 | (FR) | 36/2 R |
| 6973 | * | of 1893 | (GB) | 36/2 R |

* cited by examiner

*Primary Examiner*—M. D. Patterson
(74) *Attorney, Agent, or Firm*—Law Offices of Royal W. Craig

(57) ABSTRACT

A legging that is esthetically pleasing, amenable to ornamentation, and capable of providing warmth and comfort. It is comprised of a lower portion which engages the periphery of the foot or shoe at the bottom edge of the legging and may have means of securing the legging to the bottom of the foot or shoe, and an upper portion that adjustably engages the lower leg along its length using closures such as hook and pile fasteners. The upper portion folds over to engage the leg more securely and prevent slippage. It is designed to be easy to put on the legs and feet of a child and permit its use while walking or standing, or in an infant car seat or stroller.

1 Claim, 5 Drawing Sheets

FLEECE LEGGINGS

This Application claims benefit of Provisional No. 60/135,250 filed May 21, 1999.

BACKGROUND OF THE INVENTION

1. Field of the Invention

The present invention relates generally to leggings, and in particular to a novel combination of features which when incorporated provide improved warmth, comfort, and ease of use over prior leggings, and in particular for children.

2. Description of the Background

Small children should be protected from cold and winter weather on all portions of their body to prevent discomfort and illness. This is particularly difficult for children wearing trousers or skirts. Frequently, the movement of an active child causes socks to fall around the ankles, and trousers and skirts to ride up, which exposes the ankles and lower legs to cold and winter weather. The distinct ways in which small children are carried in infant car seats and strollers also aggravates the problem of exposing the ankles and legs of small children to the elements.

Some fashions for children compensate by using elastic or closures at the ankles. Elastic can engage the extremities of the child too tightly and cause discomfort or chafing. Closures such as buttons and hook and pile fasteners are not desirable esthetically. It is desirable to protect these areas of a child's body without having to change his or her clothes, and without having to remove his or her shoes. A solution to this problem should also be compatible with seating in an infant car seat or a stroller.

The unique advantages of synthetic fleece material, also known as spun fleece material or polar fleece material, are well described in U.S. Pat. No. 5,450,630 to Hale, and U.S. Pat. No. 5,867,837 to Otto, et al., and will only be summarized here. Synthetic fleece is a lightweight, breathable, cushioning, and quick drying material that is well suited to retaining warmth and imparting comfort. It is amenable to waterproofing treatments and can be used by itself or as a liner to a garment with a weather resistant shell. Because of these advantages, spun fleece is now commonly used in many forms of outerwear. It is disclosed for use in a sock in the above mentioned references, but nowhere in the prior art is synthetic fleece material disclosed to protect the stocking and shoe from the elements, or to protect the extremities of a child in particular.

Leggings made of knit material and designed to be worn as a stocking and engage the lower leg and foot along its length are well known in the prior art. Such leggings are not designed for use over the shoes and stockings of the wearer. Leggings made of wool or flannel material are also known in the prior art, such as U.S. Pat. No. 4,599,812 to Harmsen. These leggings do not employ synthetic fleece material for comfort and do not expose the bottom of the shoe for walking.

Protective devices such as gaiters made of waterproof material to protect the shoe, ankle, or lower leg, such as U.S. Pat. No. 4,713,895 to Vallieres, are also known in the prior art. Such waterproof gaiters provide no protection from the cold, are not amenable to ornamentation, and require attachment means to be permanently affixed to the shoe. They are primarily directed to preventing water from entering the shoe upper, or for other protective purposes.

SUMMARY OF THE INVENTION

It is, therefore, an object of the present invention to provide leggings constructed of synthetic fleece material for increased comfort and warmth that overcome the disadvantages of prior art leggings herein described.

It is a particular object of the invention to provide fleece leggings which engage the lower leg or knee of the wearer without sliding down and without causing discomfort or chafing. A further particular object of the invention is to provide fleece leggings which engage the foot or shoe of the wearer to provide warmth and comfort to the instep and sides of the foot.

Another object of the present invention is to provide leggings made of a synthetic fleece material that is easy and economical to make and that provides an excellent fit on the wearer's legs and feet whether wearing shoes or not.

A further object of the present invention is to provide a method of making synthetic fleece leggings in a facile, practical, and economical manner.

These and other objects are fulfilled by providing a fleece legging comprised of a lower portion which engages the periphery of the foot or shoe at the bottom edge of the legging and may have means of securing the legging to the bottom of the foot or shoe, and an upper portion that adjustably engages the lower leg along its length using closures such as hook and pile fasteners.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
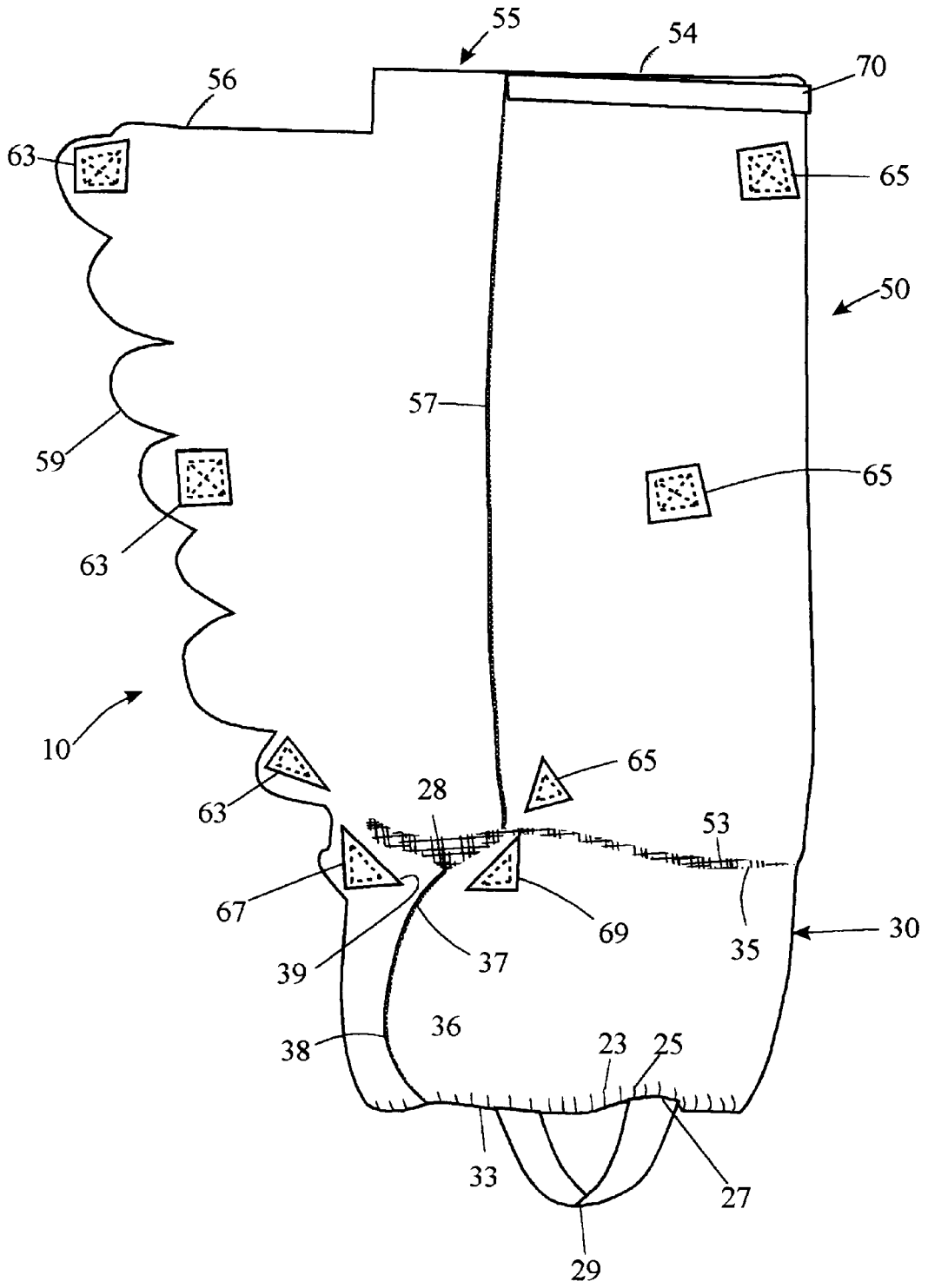
FIG.1 is a front view picture of a fleece legging 10 according to one preferred embodiment of the present invention.

Referring now to FIG. 1, which shows a synthetic fleece legging 10 according to one preferred embodiment of the present invention. A bottom portion 30 is formed from a first blank of synthetic fleece material. The bottom edge 33 of the bottom portion is secured to the foot or the shoe of the wearer by an elastic band 23 which extends around the entire circumference of the bottom edge 33 and is continuously joined to the bottom edge 33 by seam 25. The bottom portion 30 is further secured to the foot or shoe by means of a second elastic band 29 attached to opposite sides 27 of the bottom edge 33. The first side edge 36 and second side edge 38 are joined to form the enclosed bottom portion 30.

In the present embodiment, a first top portion 37 of first side edge 36 and a second top portion 39 of second side edge 38 are not joined with a seam, so that a foot with a shoe attached can enter the bottom portion 30 through the top edge 35 without stretching or tearing. In the present embodiment, a pile fastener 69 is fixed to the inside of the first top portion 37 and a hook fastener 67 is fixed to the outside of the second top portion 39 to close the bottom portion at the instep of the shoe or foot of the wearer. The present invention can easily be practiced without the hook fastener 67 and pile fastener 69.

A top portion 50 of the synthetic fleece legging 10 has bottom edge 53 joined to the top edge 35 of bottom portion 30 using a seam 28. Along the length of the inside of the first side edge 59 is a plurality of hook fasteners 63. In the present figure, the first side edge 59 is shown with an aesthetic scalloped edge. A second side edge 57 of top portion 50 is secured to the leg of the wearer by folding beneath the first side edge 59. A plurality of pile fasteners 65 is provided opposite each of the hook fasteners 63. The present embodiment can easily be practiced with a continuous hook and pile fastener running the length of first side edge 59 and the length of second side edge 57. Also, pile fasteners 65 can be of a length to engage hook fasteners 63 at adjustable points along its length.

After the shoe or foot is inserted in the bottom portion 30 of fleece legging 10, the first side edge 59 is folded over the second side edge 57, and the hook fasteners 63 are engaged with the pile fasteners 65 in such a way that the top portion 50 generally, and the top edge 55 of top portion 50 in particular, engage the leg of the wearer and hold the legging in place.

Top edge 55 comprises an upper portion 54 and a lower portion 56 which define a lip 51 which partially circumscribes top portion 50 as shown in FIG. 1. Lip 51 is folded over the lower portion 56 of top edge 55. Lip 51 is of a length comparable to the desired circumference of the top edge when engaged, and is of a width to fold over the lower portion 56 and remain in place. The twice folded over top portion 50 surrounding the leg of the wearer thus supports its own weight and resists the sliding that affects fleece socks.

To further counter this sliding effect, fasteners 70, 72 (shown in FIG. 2) are added to top portion 50 to secure lip 51. Fastener 70 is preferably a conventional hook-type fastener, and attaches to the outer face of lip 51, extending the full length circumferentially along top edge 55.

Fastener 72 is preferably a conventional pile-type fastener that mates with fastener 70. Fastener 72 is affixed to top portion 50 parallel with and below fastener 70. Fastener 72 begins at first side edge 59 and ends at side edge 57, as shown in FIG. 1.

Figure 2:
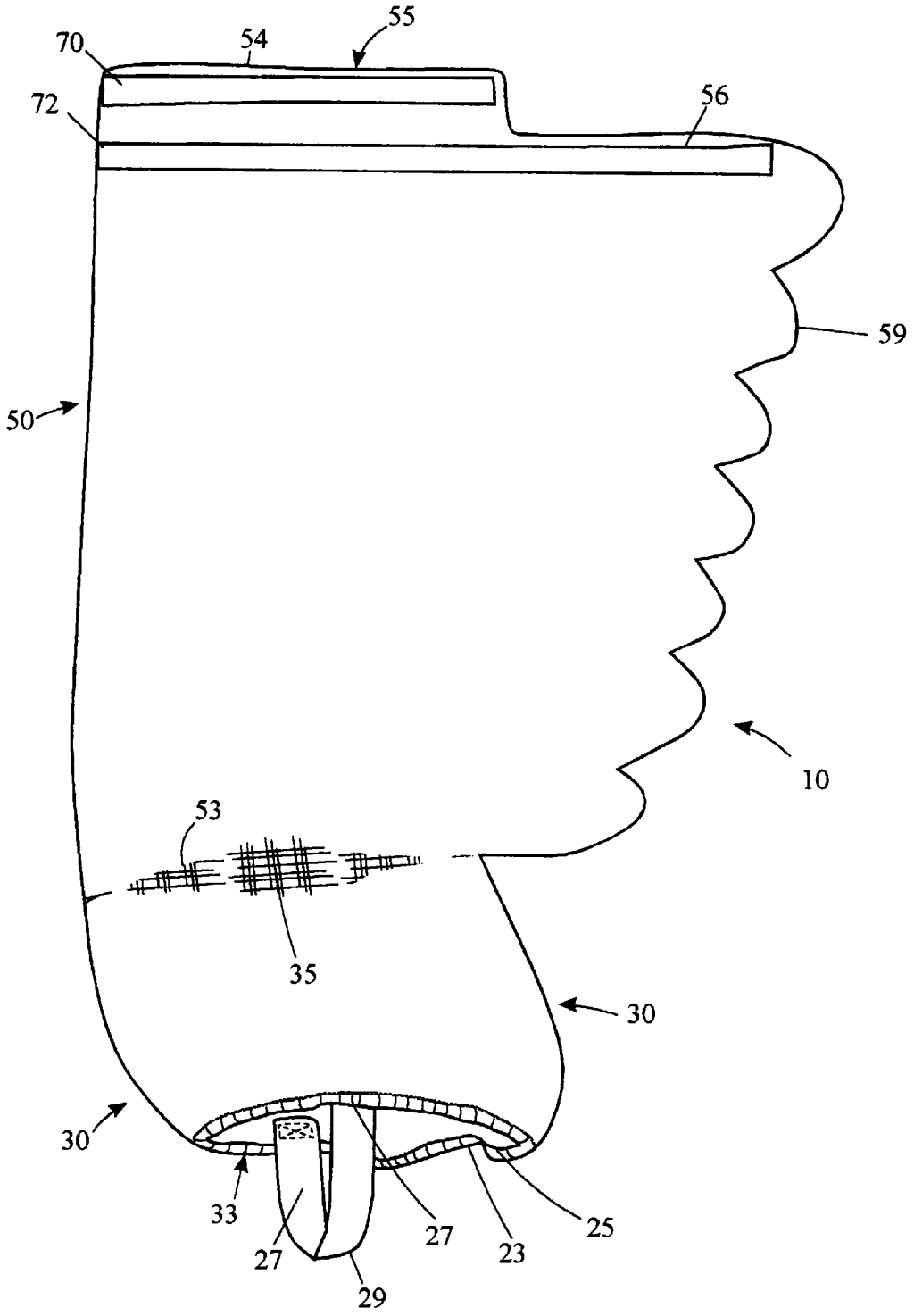
FIG. 2 is a rear view picture of the fleece legging 10 of FIG. 1.

FIG. 2 is a rear view picture of the synthetic fleece legging 10 of FIG. 1. The first side edge 59 of top portion 50, when folded over the second side edge 57, lends a smooth texture and appearance to this side of the legging, and is very amenable to ornamentation including embroidery, patches, buttons, beads, and so forth. The smooth contour of the side shown in FIG. 2 is intended for the inside of the leg. In the present embodiment, a pair of leggings is thus utilized that are mirror images of each other.

Figure 3:
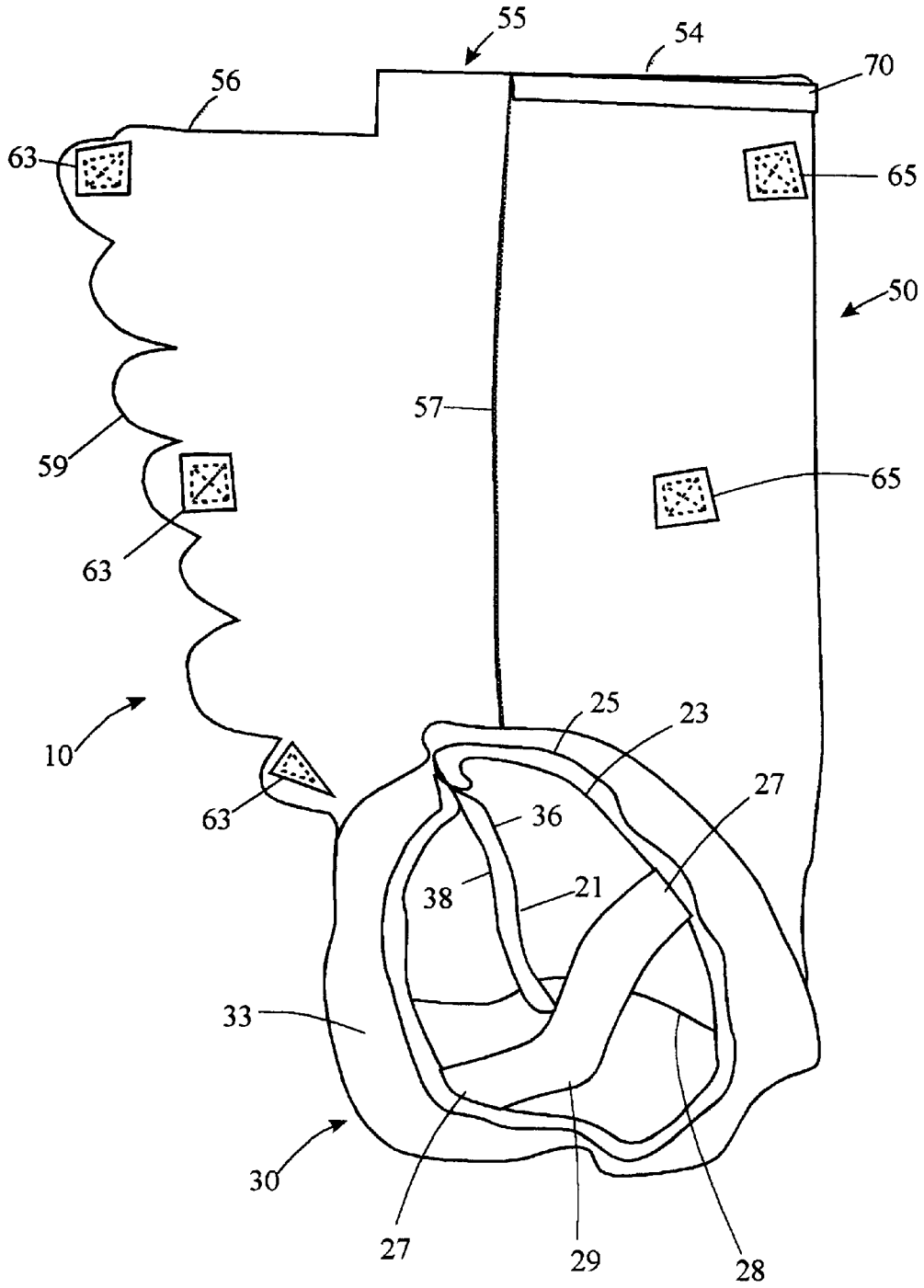
FIG. 3 is a front view picture of the fleece legging 10 of FIG. 1 in which the bottom portion 30 is turned upward to reveal the inside structure.

FIG. 3 is a front view picture of the synthetic fleece legging 10 of FIG. 1 in which the bottom portion is turned upward to reveal the inside of the bottom portion 30. The first side edge 36 and second side edge 38 are joined by a seam 21. The entire length of the bottom edge 53 of bottom portion 50 is shown joined to the top edge 35 of bottom portion 30 by seam 28. The elastic band 23 is joined to the bottom edge 33 of bottom portion 30 by a seam 25. These three seams represent all of the seams in the present embodiment, save those that may be used to join hook and loop fasteners to the legging. The absence of other or more complicated seams represents a key advantage of the present invention over much of the prior art. The present invention can easily be practiced using any other type of fastener.

Figure 4:
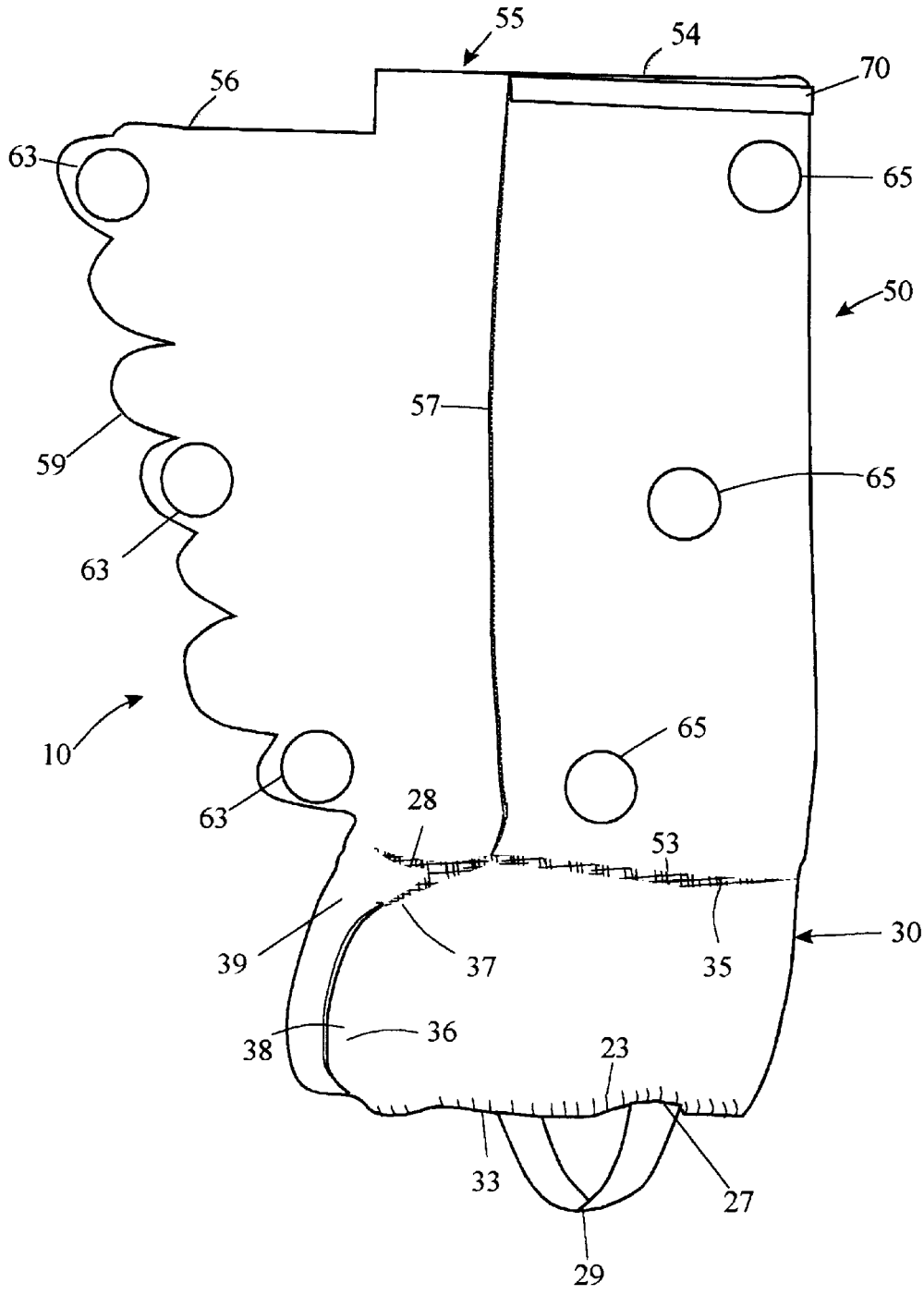
FIG. 4 is a front view picture of a fleece legging 10 according to a second embodiment of the present invention.

FIG. 4 is a front view picture of a synthetic fleece legging 10 according to a second embodiment of the present invention. First top portion 37 and second top portion 39 of the bottom portion 30 are not joined with hook and pile fasteners. This embodiment can also be easily practiced with other types of fasteners which adjustably engage first side edge 59 past second side edge 57 and over a substantial part of the circumference of top portion 50.

Figure 5:
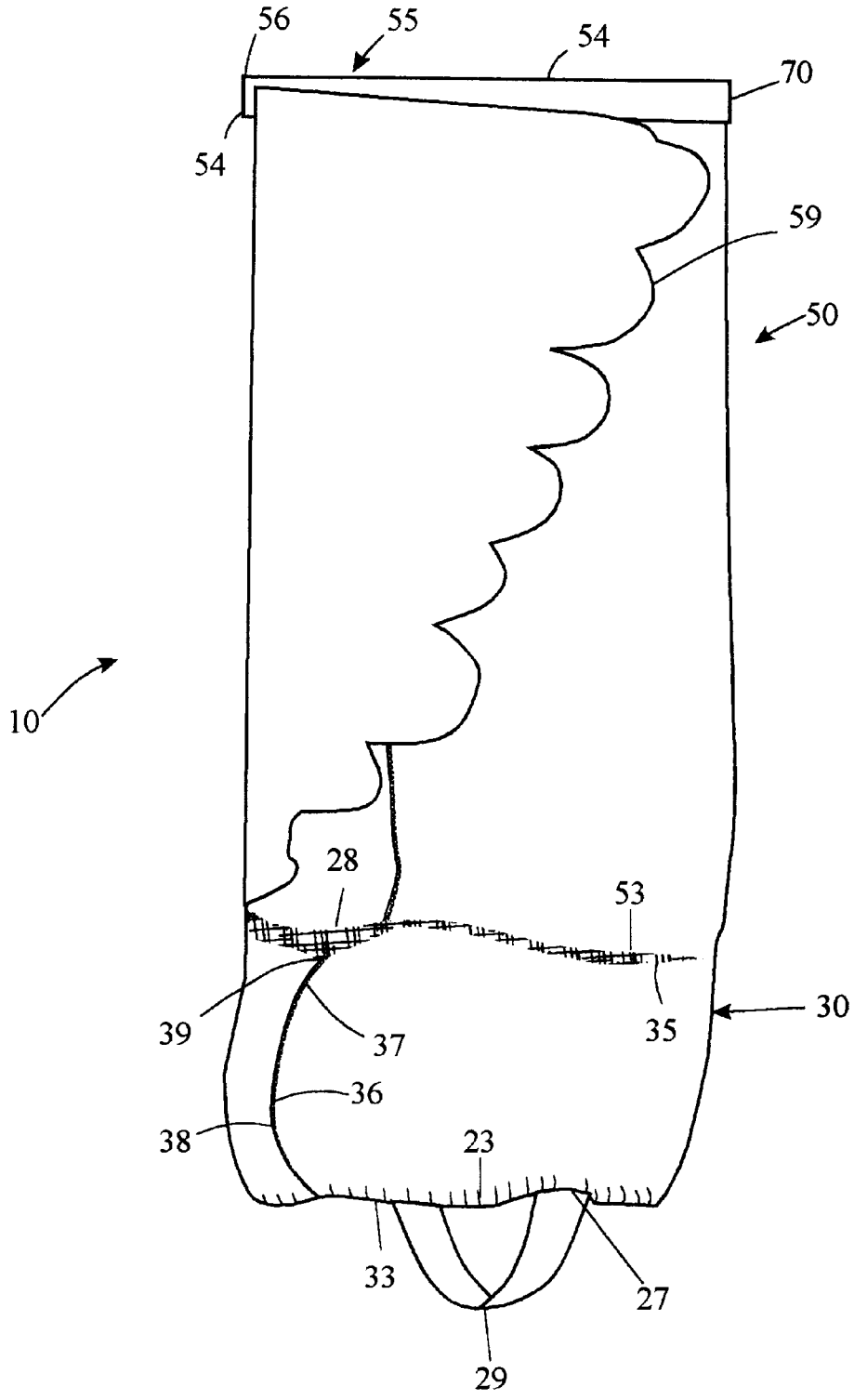
FIG. 5 is a front view picture of the synthetic fleece legging of FIG. 1 shown in a closed position.

FIG. 5 is a front view picture of the synthetic fleece legging of FIG. 1 shown in a closed position. The first side edge 59 of top portion 50 is folded over the second side edge 57, and the hook fasteners 63 are engaged with the pile fasteners 65 in such a way that the top portion 50 generally, and the top edge 55 of top portion 50 in particular, engage the leg of the wearer and hold the legging in place. The upper portion 54 of top edge 55 is then folded over the lower portion 56 of top edge 55.

The objects, and advantages of the invention have therefore been shown to be attained in a convenient, practical, economical, and facile manner.

While preferred embodiments of the present invention have been illustrated and described, it will be understood to those skilled in the art that changes and modifications may be made therein without departing from the invention in its broader aspects. For example, the present invention can easily be practiced with a single blank of synthetic fleece material of a comparable shape to the two blanks of material herein disclosed.

I claim:

1. A legging for protecting the lower extremities of a child comprising:

a bottom portion of synthetic fleece material open at both ends and defining a top edge and a bottom edge, and having means arranged circumferentially about the bottom edge for engaging a foot or shoe of said child, and a top portion of synthetic fleece material, comprising first and second side edges, and means for adjustably securing said first and second side edges of said top portion around the calves of said child, said top portion further having a top edge comprising an upper portion and a lower portion, said upper portion and lower portion defining a lip for engaging the knee or calf of said child, wherein said lip folds over said lower portion of said top edge to secure said top edge about the knee of the wearer, said lip fastening to said lower portion by a plurality of interlocking fasteners arranged around the circumference of the upper portion and lower portion, and a seam between the top edge of said bottom portion permanently attached along its length to a bottom edge of said top portion, and a fabric elastic band permanently attached across the open end of said bottom portion for securing said bottom portion over said foot or shoe, whereby the foot of said child slides through the top edge of said bottom portion and said side edges of said top portion wrap around the leg beneath the knee to protect the lower extremities of said child.

* * * * *